US007453212B2

(12) United States Patent
Selverian

(10) Patent No.: US 7,453,212 B2
(45) Date of Patent: Nov. 18, 2008

(54) CERAMIC DISCHARGE VESSEL HAVING TUNGSTEN ALLOY FEEDTHROUGH

(75) Inventor: John H. Selverian, North Reading, MA (US)

(73) Assignee: Osram Sylvania Inc., Danvers, MA (US)

( * ) Notice: Subject to any disclaimer, the term of this patent is extended or adjusted under 35 U.S.C. 154(b) by 255 days.

(21) Appl. No.: 10/906,011

(22) Filed: Jan. 31, 2005

(65) Prior Publication Data

US 2006/0170358 A1 Aug. 3, 2006

(51) Int. Cl.
*H01J 17/18* (2006.01)
*H01J 61/36* (2006.01)

(52) U.S. Cl. ..... 313/623; 313/624; 313/625; 313/567

(58) Field of Classification Search ..... 313/623
See application file for complete search history.

(56) References Cited

U.S. PATENT DOCUMENTS 3,882,346 A * 5/1975 McVey ..... 313/253
4,366,410 A 12/1982 Buher ..... 313/221
4,531,074 A * 7/1985 Nagy et al. ..... 313/331
5,424,609 A * 6/1995 Geven et al. ..... 313/623
5,810,635 A * 9/1998 Heider et al. ..... 445/26
6,774,547 B1 8/2004 Zaslavsky et al. ..... 313/285
2005/0082984 A1 * 4/2005 Wada et al. ..... 313/623

FOREIGN PATENT DOCUMENTS

EP 1 195 214 A1 4/2002
EP 1 193 734 A1 4/2004
GB 1 494 839 12/1977

OTHER PUBLICATIONS

ASM Handbook, vol. 3 Alloy Phase Diagrams, 2-381 (ASM International 1992).

* cited by examiner

*Primary Examiner*—Sikha Roy
*Assistant Examiner*—Natalie K Walford
(74) *Attorney, Agent, or Firm*—Robert F. Clark

(57) ABSTRACT

A tungsten alloy feedthrough for ceramic discharge vessels is used to form a hermetic seal with the ceramic body of the discharge vessel. The tungsten alloy comprises tungsten alloyed with a metal selected from titanium, vanadium or a combination thereof. The alloy may be formulated to have a coefficient of thermal expansion that closely matches that of the ceramic to prevent cracking. Preferably, the tungsten alloy contains from about 10 to about 35 wt. % of a metal selected from Ti, V, or a combination thereof.

13 Claims, 1 Drawing Sheet

CERAMIC DISCHARGE VESSEL HAVING TUNGSTEN ALLOY FEEDTHROUGH

BACKGROUND OF THE INVENTION

Ceramic discharge vessels are generally used for high-intensity discharge (HID) lamps such as high-pressure sodium (HPS), high-pressure mercury, and metal halide lamps. The translucent ceramic vessel must be capable of withstanding the high-temperature and high-pressure conditions present in an operating HID lamp as well as be resistant to the corrosive chemical fills. The preferred ceramic for HID lamp applications is polycrystalline alumina (PCA), although other ceramics such as sapphire, yttrium aluminum garnet, aluminum nitride and aluminum oxynitride may also be used.

In conventional ceramic discharge vessels, making the hermetic seal between the ceramic vessel and the metal electrical feedthrough can be troublesome because of the very different properties of the materials, particularly with regard to the thermal expansion coefficients. In the case of polycrystalline alumina, the seal typically is made between the alumina ceramic and a niobium feedthrough since the thermal expansion of these materials is very similar. The niobium feedthrough is joined with at least a tungsten electrode which is used to form the point of attachment for the arc because of its significantly higher melting point.

Niobium however as a feedthrough material has two significant disadvantages. The first disadvantage is that niobium cannot be exposed to air since it will oxidize and the seal will fail. This necessitates that the discharge vessel be operated in either a vacuum or inert gas environment, which increases cost and the overall size of the lamp. The second disadvantage is that niobium reacts with most of the chemical fills for metal halide lamps. This concern has lead to the development of more complex electrode assemblies for metal halide applications. For example, one prior art electrode assembly for a ceramic metal halide lamp is comprised of four sections welded together: a niobium feedthrough for sealing to the ceramic arc tube; a molybdenum rod; a Mo-alumina cermet, and a tungsten electrode. Another described in U.S. Pat. No. 6,774,547 uses a multi-wire feedthrough having a ceramic core with a plurality of grooves along its outside length with the wires inserted in the grooves. The wires, either tungsten or molybdenum, are twisted together at least at one end of the feedthrough. The twisted wire may be used as the electrode inside the lamp or a separate electrode tip may be attached to the twisted wire bundle.

SUMMARY OF THE INVENTION

It is an object of the invention to obviate the disadvantages of the prior art.

It is another object of the invention to provide a replacement for niobium feedthroughs in ceramic arc tubes.

In accordance with these and other objects of the invention, there is provided a tungsten alloy feedthrough for ceramic discharge vessels. As used herein, the term tungsten alloy means an alloy comprised of more than 50 weight percent tungsten. In particular, the tungsten alloy of this invention comprises tungsten alloyed with a metal selected from titanium, vanadium or a combination thereof. Preferably, the tungsten alloy contains from about 10 to about 35 wt. % of a metal selected from Ti, V, or a combination thereof.

DETAILED DESCRIPTION OF THE INVENTION

Figure 1:
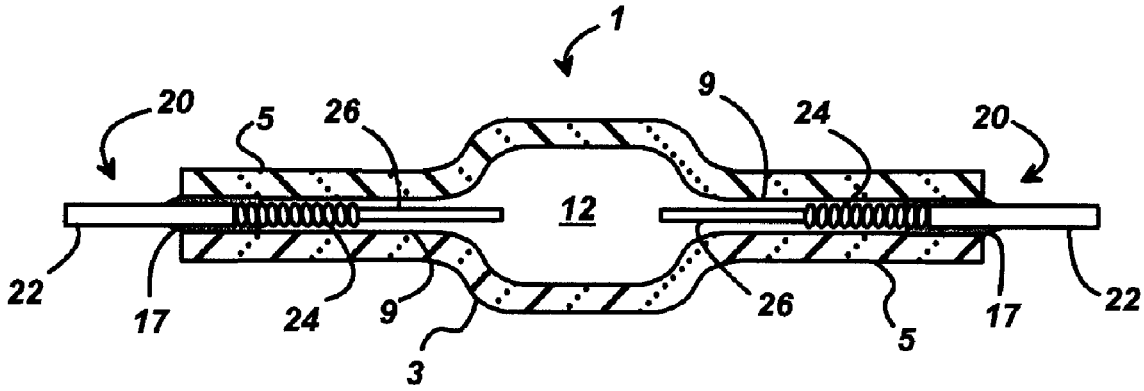
FIG. 1 is a cross-sectional illustration of a ceramic discharge vessel containing a tungsten alloy feedthrough according to this invention.

For a better understanding of the present invention, together with other and further objects, advantages and capabilities thereof, reference is made to the following disclosure and appended claims taken in conjunction with the above-described drawings.

Tungsten-titanium and tungsten-vanadium systems have the advantage that they form complete solid solutions. Furthermore, the thermal expansion coefficients of the individual metal constituents bracket the range of expansion coefficients for the conventional ceramic materials used, or proposed for use, in HID lamps. In particular, titanium and vanadium have expansion coefficients that are higher, and tungsten has an expansion coefficient that is lower, than those of important ceramic materials such as polycrystalline alumina, aluminum oxynitride and yttrium aluminum garnet. These traits allow single-phase tungsten alloys to be made that closely match the thermal expansion behavior of virtually any ceramic material with an expansion coefficient between W and Ti or V over the range of temperatures used in typical lamp sealing methods and high temperature lamp operation.

Table 1 provides the approximate alloy compositions in weight percent (wt. %) for the preferred tungsten alloy compositions for use with three major ceramic materials for HID lamps. The compositions are formulated to match the thermal expansion of the selected ceramics. The W—V alloys are expected to have a slight advantage over the W—Ti alloys in a more chemically reactive environment. These alloys can be formed into a final shape by wire drawing techniques, powder metallurgy, or casting and machining. Wire drawing is the preferred forming method because of its lower cost. The generalized composition range for the W—Ti—V alloy is given in terms of the sum of the weight percentages of titanium and vanadium in the alloy.

TABLE 1

| Ceramic | W—Ti Alloy | W—V Alloy | W—V—Ti Alloy |
|---|---|---|---|
| $Al_2O_3$ | W-25 wt. % Ti | W-22.5 wt. % V | W-(20-30 wt. %) Ti + V |
| Aluminum oxynitride (AlON) | W-16.5 wt. % Ti | W-17 wt. % V | W-(10-20 wt. %) Ti + V |
| Yttrium aluminum garnet (YAG) | W-26 wt. % Ti | W-25 wt. % V | W-(20-30 wt. %) Ti + V |

Referring to FIG. 1, there is shown a cross-sectional illustration of a ceramic discharge vessel 1 for a metal halide lamp wherein the discharge vessel 1 has a translucent ceramic body 3 preferably comprised of polycrystalline alumina, aluminum oxynitride (AlON), or yttrium aluminum garnet (YAG). The ceramic body 3 has opposed capillary tubes 5 extending outwardly from both sides. The capillaries 5 have a central bore 9 for receiving an electrode assembly 20. In this embodiment, the electrode assemblies 20 are constructed of feedthrough 22 comprised of a tungsten alloy according to this invention and a tungsten electrode 26. In a preferred embodiment, the electrode assembly 20 would be formed entirely of the tungsten alloy of this invention, preferably as a unitary structure to reduce cost. A tungsten coil or other similar structure may be added to the end of the tungsten electrode 26 to provide a point of attachment for the arc discharge.

Discharge chamber 12 contains a metal halide fill material that may typically comprise mercury plus a mixture of metal halide salts, e.g., NaI, $CaI_2$, $DyI_3$, $HoI_3$, $TmI_3$, and TlI. The discharge chamber 12 will also contain a buffer gas, e.g., Xe or Ar. Frit material 17 creates a hermetic seal between capillary 5 and the feedthrough 22 of the electrode assembly 20. A preferred frit material is the halide-resistant $Dy_2O_3$—$Al_2O_3$—$SiO_2$ glass-ceramic system. In metal halide lamps, it is usually desirable to minimize the penetration of the frit material 17 into the capillary 5 to prevent an adverse reaction with the corrosive metal halide fill. For example, a molybdenum coil 24 may be wound around the shank of the tungsten electrode 26 to keep the metal halide salt condensate from contacting the frit material 17 during lamp operation.

The tungsten alloy feedthrough of this invention may also be used in other feedthrough configurations. For example, it may be used in multi-wire feedthroughs or as a replacement for the niobium tube feedthrough in conventional high-pressure sodium lamps.

While there has been shown and described what are at the present considered the preferred embodiments of the invention, it will be obvious to those skilled in the art that various changes and modifications may be made therein without departing from the scope of the invention as defined by the appended claims.

What is claimed is:

1. A ceramic discharge vessel comprising: a ceramic body having at least one electrode assembly, the electrode assembly having a feedthrough portion sealed to the ceramic body, the feedthrough being comprised of a tungsten alloy wherein tungsten is alloyed with a metal selected from titanium, vanadium or a combination thereof and wherein the tungsten alloy contains from about 10 to about 35 wt. % of titanium, vanadium or a combination thereof.

2. The ceramic discharge vessel of claim 1 where in the ceramic body is comprised of polycrystalline alumina, sapphire, aluminum oxynitride or yttrium aluminum garnet.

3. The ceramic discharge vessel of claim 1 wherein the ceramic body has at least one capillary tube and the feedthrough is sealed to the capillary.

4. The ceramic discharge vessel of claim 1 wherein the feedthrough is sealed to the ceramic body with a frit material.

5. The ceramic discharge vessel of claim 1 wherein the ceramic body is composed of aluminum oxide and the tungsten alloy contains from 20 to 30 wt. % of titanium, vanadium or a combination thereof.

6. The ceramic discharge vessel of claim 5 wherein the tungsten alloy contains 25 wt. % titanium.

7. The ceramic discharge vessel of claim 5 wherein the tungsten alloy contains 22.5 wt. % vanadium.

8. The ceramic discharge vessel of claim 1 wherein the ceramic body is composed of aluminum oxynitride and the tungsten alloy contains from 10 to 20 wt. % of titanium, vanadium or a combination thereof.

9. The ceramic discharge vessel of claim 8 wherein the tungsten alloy contains 16.5 wt. % titanium.

10. The ceramic discharge vessel of claim 8 wherein the tungsten alloy contains 17 wt. % vanadium.

11. The ceramic discharge vessel of claim 1 wherein the ceramic body is composed of yttrium aluminum garnet and the tungsten alloy contains from about 20 to about 30 wt. % of titanium, vanadium or a combination thereof.

12. The ceramic discharge vessel of claim 11 wherein the tungsten alloy contains 26 wt. % titanium.

13. The ceramic discharge vessel of claim 11 wherein the tungsten alloy contains 25 wt. % vanadium.

* * * * *